US006715304B1

(12) United States Patent
Wycoff

(10) Patent No.: US 6,715,304 B1
(45) Date of Patent: Apr. 6, 2004

(54) UNIVERSAL REFRIGERANT CONTROLLER

(76) Inventor: Lyman W. Wycoff, 827 Haymount Dr., Indianapolis, IN (US) 46241

( * ) Notice: Subject to any disclaimer, the term of this patent is extended or adjusted under 35 U.S.C. 154(b) by 0 days.

(21) Appl. No.: 10/310,543

(22) Filed: Dec. 5, 2002

(51) Int. Cl.[7] ..... F25D 21/06
(52) U.S. Cl. ..... 62/155; 62/234
(58) Field of Search ..... 62/151, 154, 155, 62/157, 228.1, 228.5, 234

(56) References Cited

U.S. PATENT DOCUMENTS

| | | | | | |
|---|---|---|---|---|---|
| 4,316,365 | A | * | 2/1982 | Mueller et al. | 62/151 |
| 4,499,739 | A | | 2/1985 | Matsuoka et al. | 62/212 |
| 4,523,435 | A | | 6/1985 | Lord | 62/212 |
| 4,527,399 | A | | 7/1985 | Lord | 62/212 |
| 4,571,951 | A | | 2/1986 | Szymaszek | 62/212 |
| 4,653,285 | A | * | 3/1987 | Pohl | 62/126 |
| 4,724,678 | A | * | 2/1988 | Pohl | 62/80 |
| 4,788,826 | A | | 12/1988 | Higdon | 62/126 |
| 4,803,848 | A | | 2/1989 | LaBrecque | 62/183 |
| 4,807,445 | A | | 2/1989 | Matsuoka et al. | 62/212 |
| 4,835,976 | A | | 6/1989 | Torrence | 62/115 |
| 5,026,022 | A | | 6/1991 | Bastle | 251/122 |
| 5,107,684 | A | | 4/1992 | Nakayama et al. | 62/81 |
| 5,157,934 | A | | 10/1992 | Uchida | 62/212 |
| 5,187,944 | A | | 2/1993 | Jarosch | 62/225 |
| 5,209,076 | A | | 5/1993 | Kauffman et al. | 62/126 |
| 5,222,371 | A | | 6/1993 | Doyama et al. | 62/204 |
| 5,259,210 | A | | 11/1993 | Ohya et al. | 62/212 |
| 5,301,514 | A | | 4/1994 | Bessler | 62/126 |
| 5,586,445 | A | | 12/1996 | Bessler | 62/126 |
| 5,627,770 | A | | 5/1997 | Barbier et al. | 364/558 |
| 5,713,213 | A | | 2/1998 | Nobuta et al. | 62/126 |
| 5,771,703 | A | | 6/1998 | Rajendran | 62/204 |
| 5,782,103 | A | | 7/1998 | Schmidt | 62/225 |
| 5,799,498 | A | * | 9/1998 | Park | 62/154 |
| 6,018,959 | A | | 2/2000 | Schmidt | 62/225 |
| 6,058,719 | A | | 5/2000 | Cochran | 62/129 |
| 6,109,533 | A | | 8/2000 | Ao et al. | 237/2 B |

* cited by examiner

*Primary Examiner*—Marc Norman
(74) *Attorney, Agent, or Firm*—Woodard, Emhardt, Moriarty, McNett & Henry LLP

(57) ABSTRACT

In general the present invention provides a refrigeration system and a method of controlling the refrigeration system. The system includes a coolant circuit having in series a compressor, a metering device, an evaporator coil, and sensors for determining the coolant temperature and pressure within the circuit. The system also includes a defrost system that includes a fan and/or a resistive heating element. The present invention also provides a method of operating the refrigeration system to protect the individual components such as the compressor from damage from flooding with liquid coolant. Additionally, the operating method provides a more efficient operation by using a self-adaptive defrost sequence and rapid startup sequences after the defrost periods.

18 Claims, 6 Drawing Sheets

UNIVERSAL REFRIGERANT CONTROLLER

BACKGROUND OF THE INVENTION

Generally the present invention relates to a refrigeration system. More specifically, but not exclusively, the present invention is directed to systems and methods for controlling coolant flow in refrigeration systems and associated components.

A typical refrigeration system includes a compressor pumping a two-phase coolant through a circuit that includes a condenser, a metering device, such as an expansion valve, and an evaporator coil. It is important to control coolant flow through the circuit to operate the system efficiently. Further, and possibly of greater importance, controlling the coolant flow minimizes the risks for damaging the components of the system. The metering device can be used to control the flow of coolant through the evaporator coil. Too little coolant flow does not withdraw sufficient heat from the surroundings. Too much coolant flow can increase the amount of liquid coolant in the suction line, which in turn can flood the compressor causing catastrophic pump failure. One method for monitoring the coolant flow, or specifically liquid coolant, is to determine the coolant superheat level. The amount of superheat is the temperature level of the coolant above its saturation temperature level at a given pressure. Typically a system's manufacturer specifies a lower limit for the coolant superheat value to avoid flooding the compressor.

The superheat level is difficult to accurately measure and even more difficult to accurately control. Few systems actually measure true superheat. The level of superheat is typically determined by measuring the temperature drop across the evaporator coil. This can be accomplished by measuring the temperature level of the coolant immediately after the metering device and again at the outlet of the evaporator coil. Opening and closing the metering device to control the superheat level of the coolant can vary the coolant flow through the evaporator coil. For example, opening the metering device increases the amount of coolant flow and reduces the superheat value, assuming the coolant withdraws a constant amount of heat in the evaporator coil. Conversely, closing the metering device reduces the coolant flow and concomitantly increases the superheat level, again, assuming the coolant withdraws a constant amount of heat in the evaporator coil.

In addition to monitoring and controlling the coolant flow, the system should be properly maintained to ensure efficient operation. For example, the evaporator coils should be regularly defrosted to eliminate ice buildup on the coils. This allows a more efficient heat transfer from the controlled space to the coolant. During the defrost period, heat is applied to the coils. This period represents additional energy drain on the system and "downtime" because the system is not actually cooling the controlled space. Consequently, it would be desirable to only defrost the coils when necessary to efficiently chill the controlled space.

Accurate control of the refrigeration system is difficult because a refrigeration system is a dynamic system. The load on the system, i.e. the amount of heat absorbed or withdrawn by the coolant to maintain its desired temperature level in a controlled space, can frequently change. Additionally, defrost cycles interrupt operation of the system. Consequently, the load on the system can vary dramatically depending upon many factors such as the size of controlled space, the defrost cycle, system start up, and the number, size, and condition of products placed into or taken out of the controlled space.

However, despite the difficulties noted above, refrigeration systems can be operated more efficiently with less equipment failure, including fewer incidences of flooded starts and/or compressor failure, by proper maintenance and accurately controlling coolant flow. Thus, in light of the above-described problems, there is a continuing need for advancements in the relevant field, including improved methods and devices relating to controlling refrigeration systems. The present invention is such advancement and provides a wide variety of benefits and advantages.

SUMMARY OF THE INVENTION

The present invention relates to devices and methods for controlling refrigerant systems. Various aspects of the invention are novel, non-obvious, and provide various advantages. Certain forms and features, included in the invention disclosed herein, are described briefly as follows.

In one form, the present invention provides a coolant system that includes a coolant circuit having a low pressure portion and a high pressure portion, and comprises, in series, a compressor circulating coolant through the circuit; a user-selectable metering valve controlling fluid flow through a low pressure portion of the circuit; an evaporator coil, a first sensor downstream of the metering valve providing a first signal representative of a first pressure in the circuit; and a second sensor proximate to the compressor providing a second signal representative of a first coolant temperature in the low pressure portion of the circuit; and a controller operably connected to the user-selectable value. The controller is adapted to receive the first signal and the second signal, and in response generates a third signal controlling the user-selectable valve.

In another form, the present invention provides a refrigeration system including a coolant circuit for a coolant, a compressor, a metering device, an evaporator coil, and an evaporator fan. The system comprises first sensor evaluating a condition representative of a load on the fan or the amount of work performed by the fan; the first sensor can generate a first signal representative of the amount of work to the controller. The system also includes a controller operably connected to the fan and adapted to initiate a defrost sequence.

The controller also can be operably coupled to one or more memory storage devices that have instructions for initiating a plurality of predetermined defrost periods or a defrost sequence. In response to a signal from the first sensor, the controller can select one of the predetermined defrost sequences to perform. Alternatively, the controller can accumulate the total amount of time of the defrost time in the defrost sequence, and, in response to the signal form the first sensor, the process can adjust the amount of defrost time over a specified time period or defrost sequence accordingly. Additionally, the controller can evaluate the superheat level of the coolant and compare that level with a target superheat value. In response to this comparison, the controller can adjust the output of the metering device. Alternatively, the controller can evaluate the coolant pressure in the system and compare that pressure level to a target pressure value. In response to the results of that comparison, the controller can adjust the output level of the metering device.

In another form, the present invention provides a method of controlling a refrigeration system that comprises a compressor, a coolant in a coolant circuit, a metering device, an evaporator coil, and a fan positioned near the evaporator coil. The method comprises defrosting the evaporator coil for a selected defrost period; determining the difference in the load or amount of work performed by the fan measured before and after the selected defrost period; and adjusting one or more of a defrost sequence, a defrost delay period, a defrost time period, or an amount of heat transferred to said evaporator coil in response to the work difference.

In still yet another form, the present invention provides a method of controlling a refrigeration system that includes a compressor, a coolant in a coolant circuit, a metering device, an evaporator coil, and a fan proximate to the evaporator coil. The method comprises determining a superheat level of the coolant in the coolant circuit; comparing that superheat level of the coolant to a target superheat level; and adjusting a first output level of the metering device in response to said comparing by reducing the first output level by an amount equal to the sum of: a first value equal or less than about 62% of the relative flow when the coolant superheat level of the coolant is less than or equal to about one half of a target superheat value. In preferred embodiments, the controller adjusts the metering device to have a subsequent output equal to about $Y^{n+1}$ times the first output value where Y is selected to be between about 0.3 and about 0.62 and wherein n is selected to equal an amount, in degrees Fahrenheit, that the coolant superheat level of the coolant is below about one half of the target superheat value.

DETAILED DESCRIPTION OF THE INVENTION

For the purposes of promoting an understanding of the principles of the invention, reference will now be made to the embodiments illustrated herein, and specific language will be used to describe the same. It will nevertheless be understood that no limitation of the scope of the invention is thereby intended. Any alterations and further modifications in the described processes, systems, or devices, and any further applications of the principles of the invention as described herein, are contemplated as would normally occur to one skilled in the art to which the invention relates.

Figure 1:
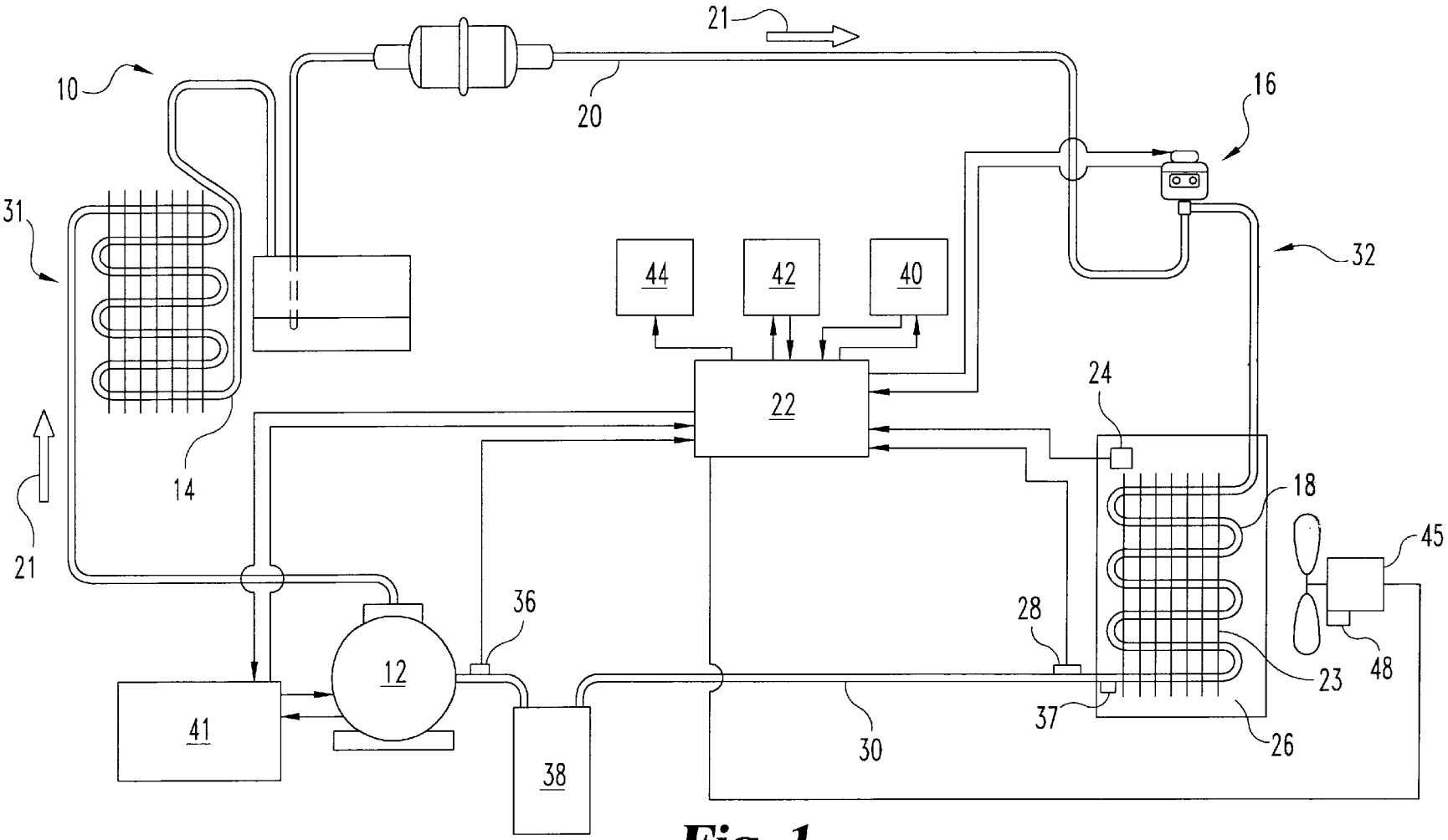
FIG. 1 is a diagram of one embodiment of a refrigeration system in accordance with the present invention.

FIG. 1 is a diagram illustrating one embodiment of a refrigeration system 10 according to the present invention. Refrigeration system 10 includes a compressor 12, a condenser coil 14, a metering device 16, and an evaporator coil 18, arranged in series about a coolant circuit 20. Compressor 12 forces a liquid coolant through a high-pressure portion 31 and then through a low pressure portion 32 in circuit 20 in the direction indicated by arrow 21. In preferred embodiments, an evaporator warming device such as an electrical heating element 23 is positioned near evaporator coil 18. Fan 45 positioned proximate to coil 18 and/or element 23 forces air over coil 18 to facilitate defrosting the coil as needed.

The refrigeration system 10 can include various sensing devices which can provide input to a controller 22, and which in turn, generates one or more output signals to control one or more devices including metering device 16 and/or compressor 12. The various sensors can include, but are not limited to, one or more of the following sensors: a temperature sensor 24 positioned in a controlled space 26, a temperature sensor 36 positioned in suction line 30, and optionally, a temperature sensor 37 positioned on or adjacent to the evaporator coil 18 either inside the controlled space 26 or outside the controlled space. A pressure sensor or pressure transducer 28 is positioned in suction line 30 in the low-pressure side 32 of system 10. A load sensor 48 is positioned on fan 45.

In one preferred embodiment, the pressure sensor 28 is provided as a pressure transducer and positioned downstream of metering device 16. More preferably, the pressure sensor 28 is positioned proximate to the outlet of evaporator coil 18. Pressure sensor 28 evaluates the coolant pressure in the low-pressure portion 32 of circuit 20. Pressure sensor 28 can be selected from a wide number of commercially available pressure sensors. Specific examples of sensors for use with the present invention include a Honeywell PC4040, Texas Instruments 2CP5-46, and a Kavlico P158-15OS-C2C.

In the illustrated embodiment, temperature sensor 36 is positioned downstream of sensor 28 in the low pressure portion 32 of circuit 20; more preferably proximate to a coolant inlet into compressor 12 between accumulator 38 and compressor 12. More preferably temperature sensor 36 is positioned within about 12 inches (30.5 cm) of the coolant inlet into compressor 12. Positioning temperature sensor 36 between the accumulator 38 and compressor 12 provides a direct reference for determining compressor superheat level. Accurate determination of compressor superheat level can provide valuable information to control the system and eliminate compressor flooding.

In response to receiving various inputs from the various sensors in circuit 20, controller 22 generates various output signals, which can control one or more devices in circuit 20. For example, in response to signals received from one or more of pressure sensor 28, temperature sensors 36 and 37, and/or load sensor 48, controller 22 can generate one or more output signals to control metering device 16, compressor 12, and/or fan 45. Additionally, or in the alternative, in response to various input signals, controller 22 can control compressor 12 preferably via compressor output controller 41. Controller 41 can include an electronic speed controller or a hot gas bypass valve to modulate the condition of the coolant from the compressor. Furthermore, controller 22 can control and or initiate one or more subroutines altering the process parameters. Altering selected process parameters can provide more efficient operation. Controller 22 can alter the initiation, frequency, and/or duration of the defrost cycles. Alternatively, controller 22 can alter the rate at which the system responds to various loads or demands for additional cooling capacity. The loads or demands for additional cooling capacity can be a result of initial system startup, resuming cooling operation after a defrost cycle, and environmental changes on the controlled space that can require additional cooling capacity. Further, controller 22 can generate one or more output signals to a memory storage device or visual display device. Controller 22 can store one or more operating parameters, which can be accessed and used at a later time to resume efficient system operation.

Metering device 16 can be selected from any commonly used and/or known metering device used in the art. For example, metering device 16 can be either a thermostatic control valve or an electronic control valve. Examples of control valves for use in this invention include uni-polar or bi-polar stepper manufactured by Danfoss, Sporlan, and ALCO or analog valves such as the ANALOID model 625 provided by Parker Hannifin, Corp. In a particularly preferred embodiment, controller 22 can be used with any readily available metering device. Thus the different metering devices are readily exchangeable in system 20.

In a preferred embodiment, metering device 16 is oversized in relation to the operational design parameters of the coolant system 10. Oversizing the metering device in accordance with the present invention provides distinct advantages. For example, selecting one of the valves listed above that has greater than about 50% capacity, more preferably greater than 100% capacity, than needed or designed for a particular refrigeration system allows the system to respond efficiently to peak load conditions. In preferred embodiments, the controller resolution is sufficiently precise to accurately modulate the oversized valves under low load conditions. Further, the oversized valves provide a greater dynamic response and the ability to clear contaminants, such as ice or internal moisture, from building up on the valve components and related structures.

In response to signal inputs from one or more of the sensors, controller 22 can receive additional input(s) by consulting a look-up table stored in memory device 40 to compare with other input signals or calculated values derived, at least in part, from the input signals. For example, the look-up table can include a listing of commercially available refrigerants for use as a coolant fluid. Alternatively, the look-up table can include predetermined or pre-selected superheat variables, target superheat values, load-operating conditions, defrost cycles, and the like. The memory device can be programmed at the point of manufacture or the memory device can be programmed or supplemented by an operator, other hardware such as another controller or processor, or software stored or loaded into controller 22 or another processing device either prior to or during operation.

Examples of input devices include one or more input and output devices 42 and 44 respectively. Preferably, controller 22 is operably coupled to at least one operator input device 42 and at least one operator output device 44. Operator input device 42 can be a conventional keyboard, keypad, touch screen interface, computer mouse, computer light pen, digitizing pad/pen arrangement, microphone, switch, or dial to name only a few, and each can be accessed either locally or remotely via a network, cable, phone line, or wireless connection. Operator output device 44 preferably is capable of producing a visual output which can be viewed by the operator such as can be provided by a printer, CRT display, LCD display, or other type of visual indicator. In addition to the memory device, or in the alternative, controller 22 can receive inputs from the one or more input devices 42. For example, controller 22 can receive operator-selected input indicative of the coolant-type, the metering device, and/or configuration; and a target superheat value, a target temperature value for the controlled spacer, defrost cycles, and the like.

Controller 22 is responsive to various inputs indicative of a performance of the refrigeration system to generate one or more output signals to control the refrigeration system in accordance with one or more predetermined routines. Controller 22 can comprise one or more components or subunits that are assembled as a common unit. When controller 22 is comprised of multiple components, one or more of these components can be remotely distributed. Controller 22 can comprise a single unit; for example, a multi-variable controller or a plurality of a single variable control units. Each single variable control unit can be dedicated to receiving signals from a single input source and control a specific device such as a metering device or alternatively the compressor (or electronic compressor control). However, controller 22 is preferably a multi-variable control unit, which receives a number of inputs and controls a number of control devices.

Controller 22 can also include digital circuitry, analog circuitry, or both. Controller 22 can be provided in the form of a digital or analog hardware dedicated to the performance of selected routines, hardware that can be programmed to execute routines input as firmware or software, or a hybrid combination of programmable and dedicated hardware. In a preferred embodiment, the software includes commercially available PC application software and includes, for example, a DOS-, Windows-, Macintosh-, Unix-, or Linux-based software. In one form, the controller includes integrated, solid-state digital processing circuitry preferable to execute a program stored in the form of binary instructions in one or more solid-state digital memory devices coupled thereto. For this form, the instructions collectively embodied in various procedures and routines to be performed by the controller in accordance with the present invention are further exemplified below.

Controller 22 also preferably includes any control box, interfaces, signal conditioners, filters, analog-to-digital (a/d) converters, digital-to-analog (d/a) converters, communication ports, removable storage media parts, or other type of circuits or operators as would occur to those skilled in the art to implement the principles of the present invention. For example, various input signals may be filtered to reduce signal noise and converted from an analog form to a digital form compatible with word processing circuitry. Also, the controller can include PI or PID processing of input and/or output signals.

In a preferred embodiment, the compressor superheat value for system 10, in operation, is determined using a combination of pressure sensor 28 and temperature sensor 36. In the illustrated embodiment, temperature sensor 36 is positioned in the suction line 30 down stream of pressure sensor 28, preferably between accumulator 38 and compressor 12.

In another embodiment, the evaporator superheat level can be determined and/or controlled in accordance with the present invention. The evaporator superheat level can be evaluated using one or more of metering device 10, temperature sensor 37, and pressure transducer 28.

Figure 2:
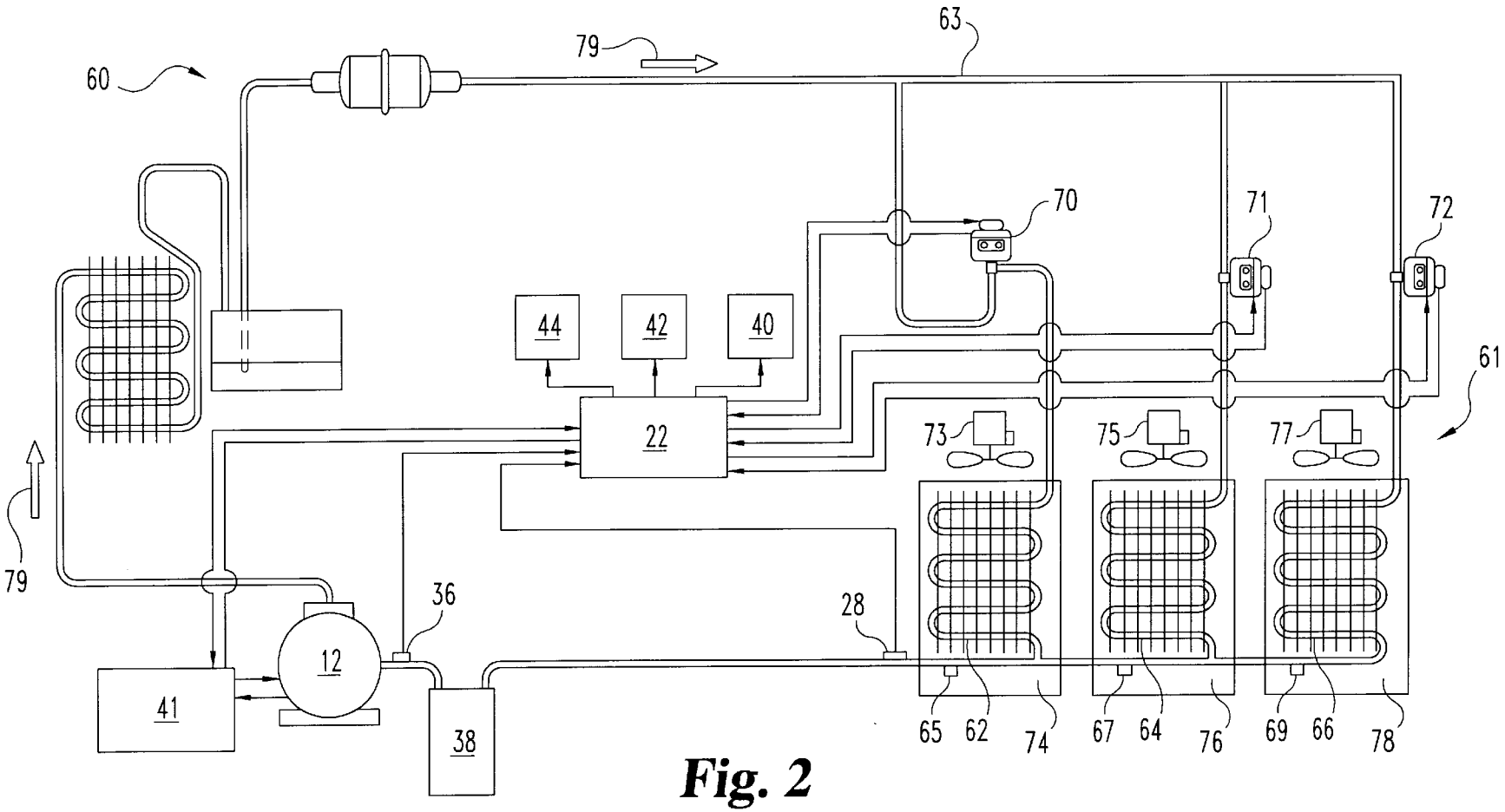
FIG. 2 is a diagram of an alternative embodiment of a refrigeration system with three evaporator coils positioned in parallel, each coil having a separate metering device.

FIG. 2 illustrates an alternative embodiment of a refrigeration system 60 for use in the present invention. Refrigeration system 60 includes many of the same components as illustrated in refrigeration system 10. Consequently, like referenced numerals will be used to denote like elements. Refrigeration system 60 includes a plurality of evaporation coils 61 in a coolant circuit 63 provided in parallel with each other. In the illustrated embodiments, refrigeration system 60 includes three evaporation coils 62, 64, and 66.

A single controller 22 can be used to control refrigeration unit 60. Each evaporation coil 62, 64, and 66 includes a metering device 70, 71, and 72, respectively. Each evaporation coil 62, 64, and 66, can be positioned to cool a different controlled space 74, 76, and 78, respectively. Alternatively, two or more of the evaporator coils 62, 64, or 66 can be positioned inside a single controlled space. Each evaporator coil, 62, 64, and 66, can include one or more evaporator fans 73, 75, and 77. Each controlled space can have a temperature sensor 65, 67, and 69. Consequently, if desired, each controlled space can be maintained at the same or at a different temperature level.

In the illustrated embodiment, although there are three evaporation coils 62, 64 and 66, a single temperature probe 36 and a single pressure sensor 28 can be provided in the suction line leading back to compressor 12. Each of metering devices 70, 71, and 72 and each pressure sensor are operably coupled to controller 22. Controller 22 can receive a single input signal representative of the temperature level of the coolant from temperature sensor 36 and a single input signal representative of the pressure in the plurality of evaporator coils 61. Additionally, controller 22 can receive individual input signals from temperature sensors inside controlled spaces 74, 76, and 78. In response, controller 22 can generate one or more output signals to control the coolant flow through circuit 63. For example, controller 22 can send individual output signals to each metering device 70, 71, and 72 to control the coolant flow through the respective devices 70, 71, and 72, and consequently, through each individual evaporation coil 62, 64, and 66.

Each of metering devices 70, 71, and 72 can be calibrated to accurately adjust or modulate coolant flow. Consequently, controller 22 can assign a value to coolant flowing through a selected metering device, either 70, 71, or 72, based upon the calibration for that selected device. Controller 22 can generate one or more signals to control the system components as discussed more fully below.

Alternatively, controller 22 can receive one or more input signals from each metering devices 70, 71, and 72 that is representative of the relative proportion that each metering device is open (or closed) relative to the fully open device. For example, metering device 70 can provide a signal to controller 22 indicative that device 70 currently allows about 50% fluid flow therethrough relative to its full open position. In response to one or more input signals from a sensor and/or value, either stored in memory or input by an operator, controller 22 can generate an output signal to metering device 70 causing device 70 to open (or close) by a value proportional to either the full open value or its current open value. Similarly, devices 71 and 72, individually, can generate signals input into controller 22 indicative of their individual relative proportional flow relative to a fully open device. In response, controller 22 can generate one or more output signals to individually control devices 71 and 72. It should be understood that the individual metering devices 70, 71, and 72 can be, but are not required to be, of a same design, model, or comparable device, or can even have the same or similar flow capacity.

In an alternative embodiment, refrigeration system 60 can include two or more evaporation coils similar to coils 62, 64, or 66, located in a single controlled space.

In still yet another embodiment, refrigeration system 60 can include two or more evaporation coils connected in series about circuit 63. A first evaporator coil having an inlet proximate to a metering device such as device 70 controlled coolant flow into a first evaporator. The first evaporator can have an outlet into a second evaporator coil, which in turn could have an outlet into a subsequent evaporator coil. Preferably, each of the evaporator coils are located in a single controlled space. In this embodiment, a single metering device can be used to modulate the coolant flow through the evaporator coils. A single temperature sensor such as sensor 65 and a single pressure transducer such as transducer 28 can be located downstream of the in-series evaporator coils.

Controlling the operation of a refrigeration system such as system 10 illustrated in either FIG. 1 or FIG. 2 can be complicated because such systems are dynamic. Further, to maintain efficient operation and to improve performance and reliability, it is important to maintain the system. Maintenance of the system includes the use of a defrost cycle to keep the evaporator coils free from ice buildup.

Figure 3:
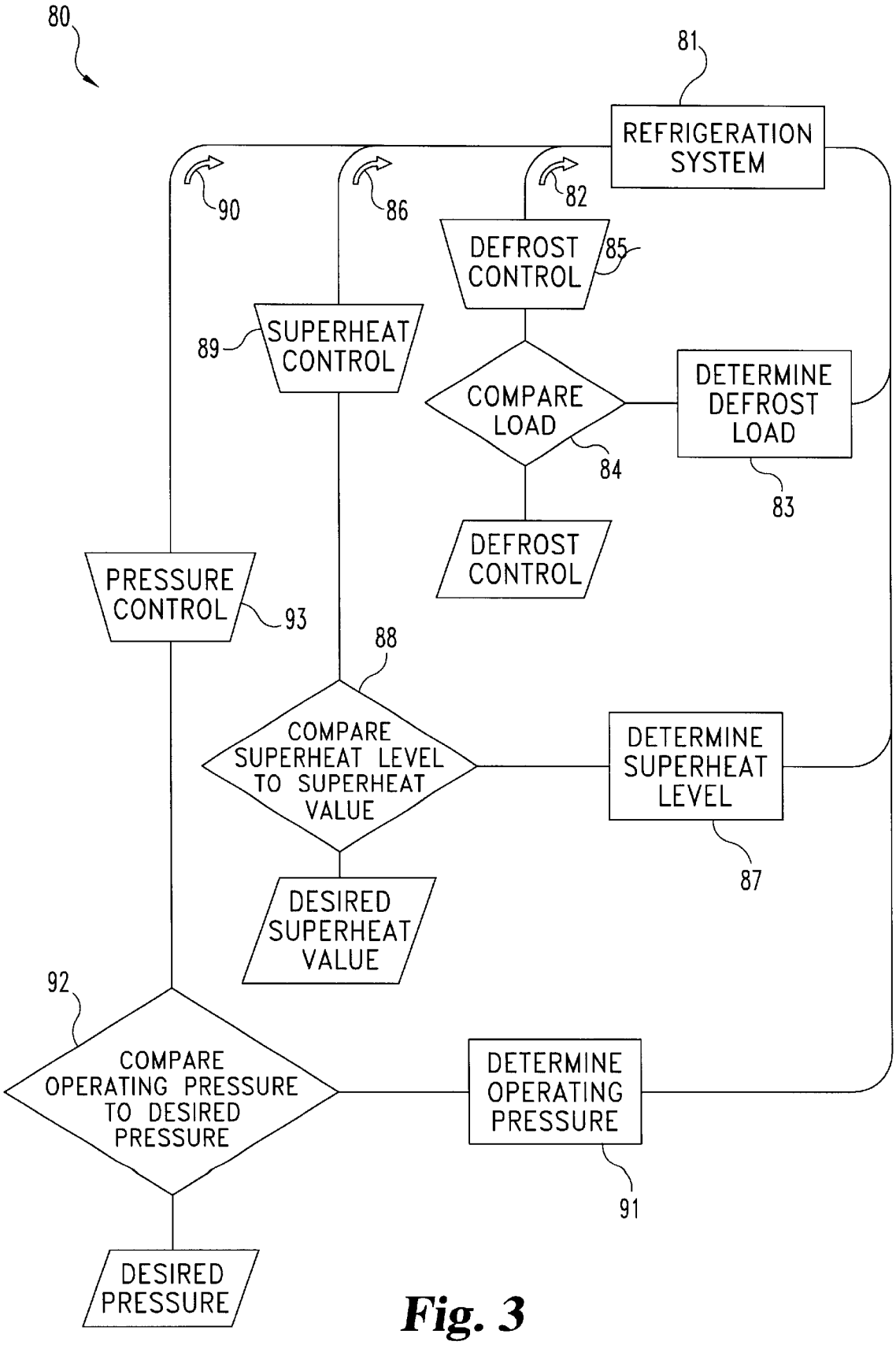
FIG. 3 is a control flow diagram illustrating one embodiment of a refrigeration control system according to one embodiment of the present invention.

FIG. 3 diagrammatically depicts three representative control loops to regulate a refrigeration operation 80. Refrigeration system 81 represents, for example, refrigeration system 10 or 60. Defrost control loop 82 controls or regulates the defrost cycle of system 81. In loop 82, defrost operator 83 represents a measurement or determination of the load on an evaporator fan. Determination of the various load difference in the evaporator fan motor provides valuable input into developing an efficient defrost strategy in accordance with the present invention.

As used herein the term load is the amount of work performed by the particular device. The load on the device can be evaluated using various methods known in the art.

The load difference or the work performed by the fan can be determined as a difference of the load on the fan motor determined before or at the start of a selected defrost period compared to the load on the fan motor determined after or at the end of the selected defrost period. Alternatively, the load on the device determined either before or after a selected defrost period can be compared to a desired or pre-selected load.

In one preferred embodiment, the load difference for the fan motor can be evaluated by determining the fan's rpm prior to and after a defrost period. A propeller-type fan blade is not capable of building static pressure against a heavily frosted evaporator coil; thus the air slips off the fan blades and allows the fan motor to operate a velocity that approximates the slip speed or synchronous speed, i.e., the rotor rpm approaches the same frequency generated by electronics. Even though the fan is operating at a higher rpm, the fan performs less work. The fan does not force air over or through the ice laden evaporator coil.

The fan's rpm can be determined using a variety of methods known to those skilled in the art including but not restricted to using a hall effect sensor and a magnet positioned on the fan shaft or a fan blade. The fan's rpm can also be determined using a capacitive proximity sensor, or a light source and a light sensitive sensor to measure light reflected from one or more of the fan blades, which could include a reflective surface. The load on the fan is inversely proportional to the fan blade's rotational velocity up to the fan's slip speed.

Alternatively, the electrical current drawn by the fan motor, measured in amperage, can be used to evaluate the load on the evaporator fan motor. In this environment, the amount of current drawn by the fan motor is proportional to the amount of work performed by the fan. Again, as ice builds up on the evaporator coil, the fan performs less work. Consequently, the amperage drawn by the fan motor is lower. As the ice evaporates the fan forces more air through the coil and the amperage drawn by the motor increases. Consequently, the load on the fan motor increases as the coils become ice free.

When the fan forces less air over or through the coil, the defrost cycle is less efficient at removing ice buildup on the coils. This in effect would nullify the percentage value of the total time used in a typical defrost period, making the typical defrost strategy less efficient. However, this effect can be used to develop a more effective adaptive defrost strategy by adjusting the time period between successive defrost periods, i.e., avoiding a longer time between defrost periods.

Comparator 84 compares the measured or determined load value or load difference with a desired value. In response, an adjustment to the defrost cycle is calculated at controller 85. Controller 85 generates one or more signal(s) to selected devices to implement the adjustment. The adjustment can include adjusting a specific defrost period or a series of defrost periods, termed herein as a defrost sequence. For example, the adjustment can include regulating the timing or frequency of a specific defrost period or a defrost sequence, triggering a defrost period, delaying a pending defrost period, adjusting the duration of a defrost period, or adjusting the amount of heat provided to the evaporator coils during one or more defrost periods.

It should be understood that the terms values and levels discussed herein, such as a desired or pre-selected value for the load on a fan, a superheat level, a pressure level, and the like, can be a range of values/levels and are not restricted to a single numerical value/level.

If the determined load or load difference on the fan or fan motor determined before and after a selected defrost period is lower than a desired or pre-selected value, then an adjustment increasing the delay period before initiating a subsequent defrost period or between a series of defrost periods can be instituted. Alternatively, the duration of a subsequent defrost period or a series of defrost periods can be reduced. In still yet another alternative, the amount of heat provided to the evaporator coil during a subsequent defrost period or series of defrost periods can be decreased. Additionally a combination of these adjustments can be instituted for the control of refrigeration system 81. If the determined load or load difference is greater than a desired or pre-selected value, then an adjustment decreasing the delay period before initiating a subsequent defrost period or between a series of defrost periods can be instituted. Alternatively, the duration of a specific defrost period or the amount of heat supplied to the evaporator coil can be increased. Further, if the determined load or load difference on the fan is equal to or within a desired or pre-selected range, no adjustment need be made to control refrigeration system 81.

The present invention also provides for a real-time monitoring and control of one or more performance parameters for the refrigeration system. For example, use of the system and control algorithms described herein, the evaporator superheat level, compressor superheat level, and controlled space temperature can be monitored and controlled either individually or in combination on a real-time basis.

Superheat control loop 86 includes operator 87 to determine the superheat level of the coolant in the refrigeration system, preferably determined between the evaporator coil and the compressor. The superheat level of the coolant can be determined using a variety of methods and sensor(s)/transducers. For example, the superheat value of the coolant can be determined by measuring the temperature level of the coolant in the circuit before the evaporator coil and measuring the temperature level of the coolant in the circuit after the evaporator coil. Alternatively, the superheat level of the coolant can be determined by using one or more temperature sensors and one or more pressure gauges or transducers. From these determined levels, a lookup table can be accessed to evaluate the superheat level of a given coolant under the process conditions. Once the superheat level of the coolant has been determined, comparator 88 compares that level with a desired or pre-selected superheat value. The desired or pre-selected superheat value can be input from a variety of sources including input by an operator or from a memory storage device. Further the desired superheat value can be adjusted during operation. Once a comparison has been performed, controller 89 initiates one or more adjustments to refrigeration system 81. If the determined superheat level is lower than a desired or pre-selected value, then an adjustment is made to a metering device to decrease the output level or mass of coolant entering into the evaporator coil. Alternatively, if the determined superheat level is higher than a desired or pre-selected value, then an adjustment is made to a metering device to increase the output level or the mass of coolant entering into the evaporator coil. Comparator 88 and/or control 89 can also receive a signal from control loop 90, discussed below more fully, that is indicative of an adjustment to one or more selected devices such as the metering device to regulate the amount or level of coolant superheat.

Pressure control loop 90 includes a pressure operator 91 to determine the operating pressure of the refrigerant or coolant in the low-pressure portion of a coolant circuit. For example, pressure operator 91 can receive a signal from one or more sensors such as sensor/transducer 28 illustrated in FIG. 1 or 2. Comparison operator 92 receives a signal representative of a refrigerant pressure level from operator 91 and compares that value or level with a pre-selected or desired value. The desired or pre-selected pressure value can be input from a variety of sources including input by an operator or from a memory storage device. Further, the desired pressure value can be adjusted during operation. In response to that comparison, pressure control 93 provides an adjustment to one or more devices such as metering device 16 or fan 45 to regulate the pressure in the refrigeration system. If the determined pressure level is lower than a desired or pre-selected value (lower pressure, greater vacuum), then an adjustment to increase the output of a metering device or increase the coldness (increase the amount of heat the evaporator coil can withdraw from a controlled space) is initiated. Alternatively, if the determined pressure level is greater than a desired or pre-selected value (higher pressure, less vacuum), then an adjustment is initiated to decrease the output of a metering device or decrease the amount of heat actually withdrawn by the evaporator coil or a combination of both. Control 93 can further adjust the selected device(s) such as the output level of a metering device to maintain refrigeration system within a desired set of operating parameters to protect system components, protect the contents of the controlled space, or maintain operation efficiency.

Preferably, control loops 82, 86, and 90 are embodied in routines executed by process controller 22. It should be appreciated that adjustment of the control 85, 89, and 93 of each loop 82, 86, and 90, respectively, may result in a change to a parameter being controlled by another of the loops 82, 86, and 90. Thus, depending on the selected controls, control loops 82, 86, and 90 may be loosely or tightly coupled to each other. To maintain stability in view of such coupling, appropriate dampening with PI, PID, or other regulators can be utilized in accordance with techniques known to those skilled in the art.

Figure 4:
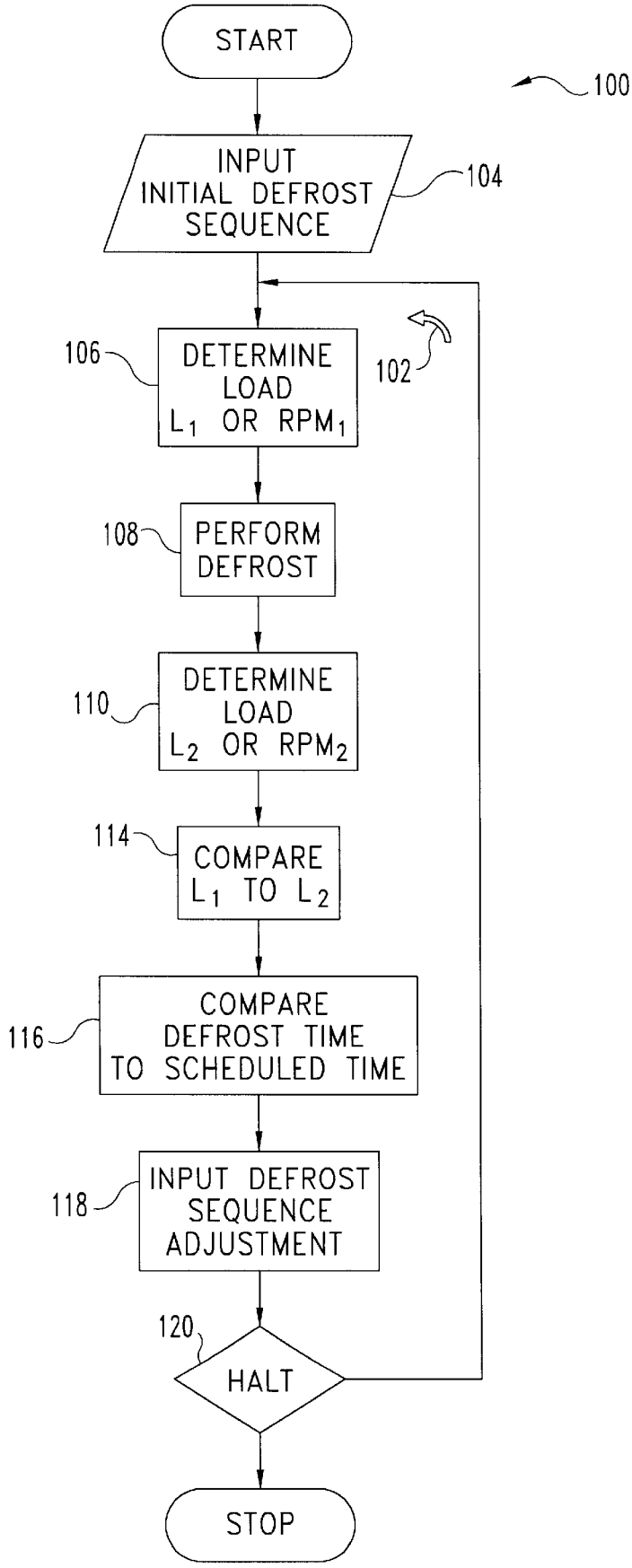
FIG. 4 is a flow chart illustrating one embodiment of a defrost control loop for use in the present invention.

FIG. 4 illustrates in flow chart form one embodiment of a routine 100 for controlling a defrost control loop 102 for use in the present invention. Defrost control loop 102 corresponds to loop 82 in FIG. 3. In one embodiment, the defrost control loop 102 is not dependent solely upon a time-time or a time-time/temperature termination of one or a series of defrost periods. A defrost control loop, according to the present invention, adjusts to the dynamics of the refrigerator system and/or the controlled space. More directly, the defrost cycle of the present invention adjusts to the physical condition of the evaporator coils.

In a particularly preferred embodiment of the present invention, a self-adapting defrost control loop uses a performance-based equation in conjunction with sensors to measure the load on a fan to effectively execute an energy-saving creative defrost strategy. The strategy can include determining the load on a fan blade or fan motor with or without a resistive heating element proximate to the evaporator coil. The load on the evaporator fan can be evaluated considering the amount of air forced over or through the evaporator coils. The load also can be determined considering the fan's rotational velocity, i.e., the fan's rpm. Alternatively, the load can be determined by evaluating the amperage drawn by the motor. The load value or the load difference can be stored in one or more of memory devices 42 or 40.

It should be understood that load on an evaporator fan can be determined at the beginning of a defrost period and again at the end of a defrost period.

At stage 104, a controller is initiated with the various input values. The controller can be input with values including current time and a default frequency index or lookup table; optionally, various other variables can be entered including, but not restricted to, parameters specified by the system's maker, coolant type, historical data relating to previous operation, values relating to the controlled space, and/or items located in that controlled space.

The input date for a default frequency index can be conveniently provided in a look-up table that is preferably stored in a non-volatile memory and is readily accessible by the controller. One example of a frequency index is provided below in Table 1.

TABLE 1

| | | Defrost Frequency Index | | | | | |
|---|---|---|---|---|---|---|---|
| Index | Frequency Matrix | Defrost Cycle Initiation Time | Defrost Cycle Initiation Time | Defrost Cycle Initiation Time | Defrost Cycle Initiation Time | Defrost Cycle Initiation Time | Defrost Cycle Initiation Time |
| 5 | 6 in 24 hours | 2 a.m. | 6 a.m. | 10 a.m. | 2 p.m. | 6 p.m. | 10 p.m. |
| 4 | 4 in 24 hours | 4 a.m. | 10 a.m. | 4 p.m. | 10 p.m. | — | — |
| 3 | 3 in 24 hours | 8 a.m. | 4 p.m. | 12 a.m. | — | — | — |
| 2 | 2 in 24 hours | 8 a.m. | 8 a.m. | — | — | — | — |
| 1 | 1 in 24 hours | 8 a.m. | — | — | — | — | — |
| 0 | 1 in 48 hours | 8 a.m. | — | — | — | — | — |

Typically each defrost period will have associated a time period or duration termed herein as a scheduled defrost time period. For example for an index of 3 each of the three defrost periods can be scheduled to begin at a specified time and continue for a specified time period. It should be understood that the three defrost periods need not have the same specified defrost time period. Consequently each index also will have a set accumulated defrost time period, which is the total possible amount of defrost time over the cycle time period of the frequency index (either 24 or 48 hours in Table 1). After each defrost period is complete the system will return to normal cooling operation. Additionally, or in the alternative, each defrost can be terminated early using the input from a temperature sensor located on the evaporator coil such as sensor 37 or a pressure sensor 36. If the temperature level on the evaporator coil is indicative of an ice-free coil, then the defrost period can be terminated before the expiration of the scheduled defrost time period.

The time period between the end of the preceding defrost period and before the next defrost period is termed herein as the defrost delay period. Referring to Table 1, for an index of 3 and a scheduled defrost period of 10 minutes, the defrost delay period between the 8 a.m. and 4 p.m. defrost periods is about 7 hours and 50 minutes.

In one embodiment, a frequency index such as illustrated in Table 1 provides advantages of scheduling defrost cycles convenient for the operator or for the intended use of the refrigeration system. For example it may be desirable that the defrost period not begin during certain periods. While specific defrost start times have been indicated in Table 1, it is understood that different start times and/or a different frequency index can be provided to the controller as desired. It will be understood that the data listed above in Table 1 are illustrative and are not intended to restrict or limit the invention in any fashion.

Typically an operator would input a selected frequency index to initiate routine 100 at stage 104. By selecting one of the frequency index variables 0 to 5, an operator can selectively program the initial defrost control operation or sequence to operate according to the frequency matrix. For example, by selecting frequency index 3, listed in Table 1, the defrost control cycle will undergo 3 defrost cycles or periods in 24 hours. The first period will begin at 8 a.m., the second period will begin at 4 p.m., and the final period in the 24-hour cycle will begin at 12 a.m. In one embodiment, one complete cycle from the frequency index is performed before routine 100 continues to the next stage. In subsequent iterations of loop 102, either a single defrost period or a series of defrost periods can be performed before a change in the operation is initiated. As noted above, the defrost periods can be terminated either using a time-time or a time-time/temperature process indicative of a time-initiated and time-terminated or a temperature-terminated or pressure-terminated cycle.

Control loop 102 is entered after stage 106. At stage 106, the controller receives an input indicative of the load, $L_1$, on the fan; for example the fan's rpm or the current drawn by the fan's motor. For example, fan unit 45 illustrated in FIG. 1 can be monitored to provide an input into controller 22 indicative of the rotational speed of the fan RPM,. One or more of memory devices 42 or 40 can be used to store this data.

After determining the load on the fan, stage 108 is encountered to perform a defrost period. The defrost period is typically terminated by the controller with inputs from either a timer, a temperature and/or pressure signal representative of the scheduled defrost time, the temperature from sensor 37 or the pressure from sensor 28, respectively.

Next at stage 110 the load, $L_2$, on the fan is determined, which in this example is the fan's rpm, $RPM_2$. This input value, $RPM_2$, is then provided to the controller to be stored into an adaptive memory such as 44 or 40. In this sequence, $RPM_2$ is equal to or less than $oRPM_1$. If the evaporator coil is free of ice, then $RPM_2$ is equal to $RPM_1$. On the other hand, if the coil is encrusted or partially coated with ice, then $RPM_2$ will be less than $RPM_1$. If the evaporator coils contain sufficient ice to restrict airflow, the fan performs less work immediately prior to the defrost period, and the rotational velocity of the fan approaches the slip speed or synchronous speed..

The actual time for the defrost period is determined. This actual defrost time can be stored into an adaptive memory. Additionally the actual defrost times for successive defrost periods within a set defrost sequence can be accumulated and that accumulated time value stored in the adaptive memory for use in subsequent operations.

Next, at comparator stage 114, the value for $L_1$ is compared to the value for $L_2$. For example if the value for $L_1$ ($RPM_1$) is greater than the value for $L_2$ ($RPM_2$), a flag equal to 1 is stored in an adaptive memory for use in subsequent operations. If L1 ($RPM_1$) is equal to $L_2$ ($RPM_2$), a flag equal to 0 is stored in an adaptive memory at stage 114 for input into a subsequent calculation. At calculation stage 116, the value X equal to the actual defrost time period divided by the scheduled defrost time period is evaluated and stored in memory for use in adjusting the defrost cycle period.

After 116 control stage 118 is encountered. At stage 118, an adjustment to the defrost sequence is calculated. If the flag is equal to 0, then the load on the fan after the defrost period is equal to the load on the fan prior to the defrost period. For that selected defrost sequence, the evaporator coils do not contain a significant amount of ice buildup to block the air flowing from the fan over the evaporator coil. Consequently, the defrost sequence is either sufficient or may be too aggressive under those operating conditions/environment. The value of X is evaluated to determine if the defrost sequence is too aggressive. If the flag is zero and X is less than a predetermined value, i.e., the actual defrost time divided by the scheduled defrost time is less than the predetermined value, then an adjustment to the defrost sequence is performed. In preferred embodiments, that predetermined value is less than about 0.6, more preferably less than about 0.5, still more preferably less than about 0.3. The adjustment can include decreasing the amount of heat provided to the coils during the defrost. The adjustment can also include decreasing the duration of a scheduled defrost period or the amount of accumulated defrost time over the specified time period. In addition or in the alternative, an adjustment can increase the defrost delay period or the amount of time delay between successive defrost periods. In a preferred embodiment, the adjustment includes as an input selecting the next lower index level from a lookup table such as that illustrated in Table 1 above. In the current example, the initial index level of 3 would be decreased to an index level of 2. This would provide two defrost periods within a 24-hour time period for subsequent operation of the refrigeration system.

On the other hand in this example, if the flag is 1, i.e. $RPM_2$ is less than $RPM_1$, this condition indicates that the evaporator coils still contain ice immediately after the defrost period. If X is determined to be greater than a predetermined value, i.e., the actual defrost time divided by scheduled defrost time is greater than a second predetermined value, then a longer defrost period, more frequent defrost periods and/or shorter defrost delay periods can be implemented to de-ice the evaporator coils. Preferably, an adjustment to the defrost sequence is performed to increase cooling efficiency. In preferred embodiments, the second predetermined value is greater than about 0.75, more preferably greater than about 0.8. Since the flag is set, the work performed by the fan is less at the beginning of a defrost cycle than at the end; i.e., the $RPM_1$ is greater than $RPM_2$. Consequently, the evaporator coil has an ice build up. Furthermore when the second predetermined value is 0.75, greater than 75% of the scheduled defrost time is needed to de-ice the evaporator coil. The adjustment can include increasing the amount of heat provided to the coils during defrost. Additionally the adjustment can include increasing the duration of a scheduled defrost period or increasing the amount of accumulated defrost time over the specified time period. In addition, or in the alternative, the adjustment can include decreasing the amount of the defrost delay period between one or more successive defrost periods. In a preferred embodiment, the adjustment includes as an input into the next cycle of loop 102 the next higher index level from a lookup table such as that illustrated in Table 1 above. In the current example, the initial index level of 3 would be increased to an index level of 4. This would provide four defrost periods within a 24-hour time period.

If flag is equal to 1 and X is determined to be greater than the first predetermined value but less than the second predetermined value, no change or adjustment in the defrost sequence is entered.

Once an adjustment decision has been determined, the associated random access memory values are cleared for the next period's usage, and control loop 102 returns to routine 100 immediately prior to control block 106. In alternative embodiments, a complete defrost sequence is performed before an adjustment is entered. In this case the values of $L_1$, $L_2$, and X or their comparisons, can either be accumulated or averaged over the defrost sequence. The accumulate and/or averaged values can be carried into memory for subsequent operations as described above. Loop 102 continues until desired, in which case decision stage 120 is encountered to halt the routine.

Typically, residential and commercial refrigeration and air conditioning systems employ a compressor suitable for vapor compression duty only. Liquid coolant returning inadvertently through the suction line to these compressors will cause some level of damage in every instance. The damage may be subtle and accumulative, or immediate and catastrophic, but damage of some level will be sustained. To minimize, and in most circumstances prevent, liquid coolant from returning to the compressor, the coolant must be returned superheated or be in the vapor phase without any condensed or liquid coolant. One way of determining that the coolant is in the vapor phase is to measure the coolant superheat value. A coolant is assumed to be superheated when the actual measured temperature level of the coolant is greater than the saturation temperature of that coolant at the present pressure level. The present invention provides a method of operating a coolant system designed to monitor and control the system to measure. superheat of the coolant and to ensure or minimize the amount of liquid coolant returning to the compressor.

Figure 5:
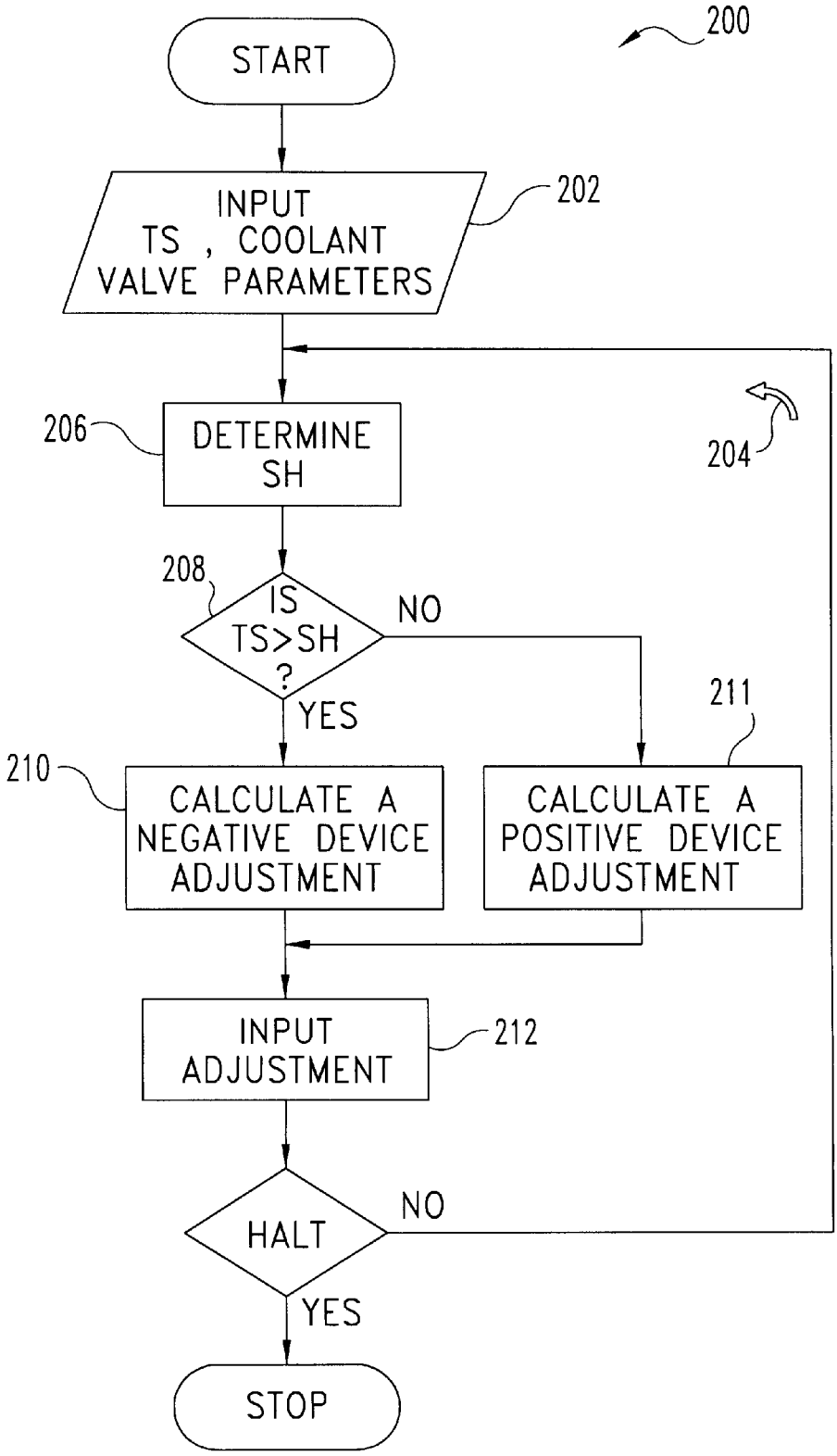
FIG. 5 is a flow chart illustrating one embodiment of a superheat control cycle according to one embodiment of the present invention.

FIG. 5 illustrates one embodiment of a control operation 200 for use in the present invention to monitor and control the superheat value of the refrigerant or coolant. In one embodiment, the control operation 200 can be used in conjunction with routine 100 illustrated in FIG. 4. Referring again to FIG. 5 and routine 200, initialization and input of selected parameters occurs at stage 202. The various parameters or variables that can be entered include the coolant type, particular system parameters such as metering valve size, its output capacity, desired temperature in the controlled space, and the target superheat value, TS, as selected or indicated by the compressor and/or refrigerant system manufacturer. Superheat control loop 204 is entered at stage 206. At stage 206, the superheat coolant level, SH, for the operating system is determined. Various methods can be used to determine the superheat level. Selected methods include measuring the temperature difference of the coolant immediately before and immediately after the evaporator coil as described in U.S. Pat. No. 4,571,951. Alternatively, the superheat can be determined using a temperature sensor located in the suction line downstream of an accumulator or an EPR, typically within about 12 inches of the suction line's penetration into the compressor body. The temperature sensor, in conjunction with a pressure sensor located immediately after the evaporator coil, can be used to determine the superheat level for the liquid refrigerant immediately before it enters the compressor body.

Next, comparator stage 208 is encountered. At stage 208, the superheat level, SH, is compared to one-half the target superheat value, TS. If the calculated or determined superheat level, SH, is less than or equal to approximately one-half of the target superheat value, TS, i.e., the decision from stage 208 is "YES", then stage 210 is encountered. At stage 210, a negative adjustment is calculated to increase the coolant superheat level in the operating circuit. Typically this involves decreasing the output of the metering device and decreasing the amount of coolant flowing through the evaporator coil.

It is important to minimize the amount of "hunting" that a controller will perform to settle on a set of operating parameters. Often this involves a compromise between allowing large incremental adjustments in the metering device output level for a rapid response and small incremental adjustments in the metering device. Large adjustments can "over shoot" the optimal value, and consequently, require a similarly large counter-adjustments. Conversely, small adjustments require longer periods to reach a optimal set of parameters. Additionally, the system, may not significantly reflect the effects derived from the adjustments, causing the controller to wander aimlessly without settling on an optimal set of parameters. One method of balancing the two alternatives is to allow the controller to institute varying degrees of adjustments depending upon the value of the difference or error between the target superheat value and the determined superheat value. As noted above, the targeted superheat value can be a targeted range of values.

At stage 210 an adjustment to modify the superheat value of the coolant in the circuit is made. In a preferred embodiment, if the calculated or determined superheat level, SH, is less than or equal to approximately a target value determined as a fraction of the superheat level, then the metering device is adjusted such that the device output level is reduced. The target value can be selected as desired. Preferably, the target value is selected to be between 0.75 and 0.25 times SH; in more preferred embodiments the target value is selected to be about 0.5 times or one-half of the target superheat value, TS. In preferred embodiments, the output level is reduced by a value equal to or less than about the reciprocal Fibonacci ratio (approximately 0.62 or more accurately 0.618), more preferably less than or equal to about one-half of the normal output level.

For example, some refrigeration systems have a target superheat value, TS, of about 20° F. If the operating superheat level, SH, is determined to be less than or equal to about one-half of the TS, i.e., about 10° F., if the metering device is operating at an initial output level, $O_1$ equal to 100% full output capacity, then the controller initiates an adjustment to the metering device to provide a subsequent output level, $O_2$, equal to about 50% of $O_1$. In a preferred embodiment, an adjustment can be made to modify the output level of the metering device to account for the amount that the superheat level is less than about one-half of TS. The controller can initiate an adjustment to metering device to reduce the output by about one-half for each degree of superheat level below about one-half the target superheat value. As an example, if TS is about 20° F. and SH is determined to be about 5° F. then SH is about 5 degrees below about one-half of TS, i.e., (TS/2)−SH. In this example, the controller can initiate an adjustment to the metering device to reduce an initial output level, $O_1$, of 100% full capacity to a subsequent output level, $O_2$, equal to about 1.5% full capacity. Equation 1 shown below illustrates one embodiment for determining a subsequent output level, $O_2$, based upon the initial output level, $O_1$, and the difference between one-half TS and the SH:

$$O_2 = O_1 \times (0.5^{n+1}) \tag{1}$$

where n, as listed immediately above, is equal to the amount in degrees Fahrenheit that the coolant superheat level is below about one half the target superheat level, i.e., (TS/2)−SH.

In an alternative embodiment, the reciprocal Fibonacci ratio can be used by the controller to calculate an adjustment to the metering device. Consider the Example mentioned above with a refrigeration system designed to have a TS value of 20° F. and a superheat level SH determined in operation of about one-half TS, i.e., about 10° F. or below. If the metering device is operating at about 100% full value capacity or $O_1$ is about 100%, the controller can initiate an adjustment to the metering device to reduce the initial output, $O_1$, to a subsequent output value, $O_2$. In this embodiment, the adjustment can be determined by multiplying the initial output value, $O_1$ by reciprocal Fibonacci ratio or $O_2$ equals 0.62 times 100% which is equal to 62% full value capacity. In a more preferred embodiment, for every degree (° F.) that the measured superheat value, SH, is below one-half of the target superheat value, TS, i.e., (TS/2)−SH, the controller initiates an adjustment to the metering device to provide a subsequent output level, $O_2$, equal to about the value of the reciprocal Fibonacci ratio to the n+1 power times the initial output level, $O_1$, where n is selected to equal the amount in degrees Fahrenheit that the coolant superheat level is below about one half the target superheat level. An adjustment to the initial output level of the metering device can be provided as shown in Equation 2 below:

$$O_2=O_1\times(0.62^{n+1}) \quad (2)$$

where n, as listed immediately about, is equal to the amount in degrees Fahrenheit that the coolant superheat level is below about one half the target superheat level, i.e., (TS/2)−SH.

In still yet an alternative embodiment, the for every degree (° F.) that the measured superheat value, SH, is below the target value or one-half of the target superheat value, TS, i.e., (TS/2)−SH, the controller initiates an adjustment to the metering device to provide a subsequent output level, $O_2$, equal to about $Y^{n+1}$ times the initial output level, where the value for Y is selected to be a value between about 0.3 and about 0.62. Consequently, an adjustment to the initial output level of the metering device can be determined as shown in Equation 3 below:

$$O_2=O_1\times Y^{(n+1)} \quad (3)$$

where Y and n are as described above.

On the other hand, if the result of stage 208 is "NO"; i.e., the determined superheat level is greater than one half of the target superheat level, TS, stage 211 is encountered. At stage 211, a positive adjustment to the metering device is calculated. The adjustment can include increasing the coolant flow through the evaporator coil by increasing the flow through the metering device. In a preferred embodiment, the amount of the metering device flow is increased using a standard PID algorithm.

At stage 212 that adjustment calculated at stage 210 is entered and/or performed. After stage 212, control loop 204 can be repeated as desired, with or without a delay period before re-evaluating the operating pressure.

It should be noted that implicit within the operating parameters are variables for maintaining a desired environment within the controlled space. In the control hierarchy, either the conditions for maintaining the controlled space or for maintaining equipment protection or a combination thereof can be selected. For example, if the products in the controlled space are deemed of more importance than the equipment (including the compressor), then an adjustment to the metering device to maintain a desired temperature level in the controlled space can take precedence over adjustments to the metering device to reduce flooding the compressor. Ideally, the controller optimizes efficient operation so that the temperature level in the controlled space is maintained while at the same time the operating superheat level is maintained within the desired parameters.

Most compressor manufacturers and/or refrigerant system manufacturers design their systems to operate at a maximum back pressure. Exceeding this pressure rating can cause compressor motor overloads to trip due to high amperage and cause accumulative damage, as well as damage to the refrigerated product, due to unexpected or extended compressor time off. The compressor most likely is damaged under high load conditions such as occurs directly after a defrost period, typically called the "pull down cycle."

Figure 6:
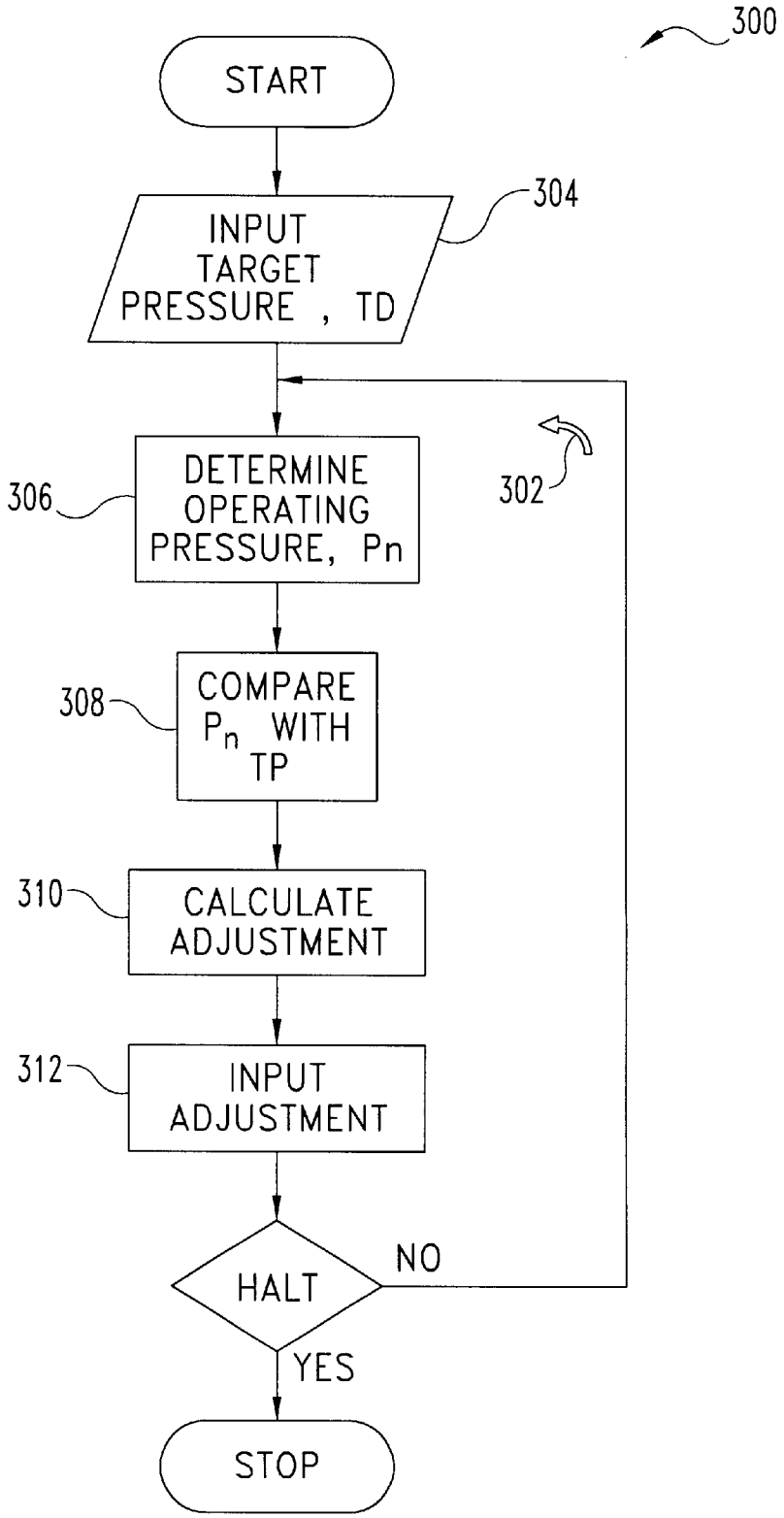
FIG. 6 is a flow chart illustrating an alternative embodiment of a superheat control cycle according to one embodiment of the present invention.

FIG. 6 illustrates one example of a routine or method for controlling the operating pressure within a refrigerant system as illustrated in FIG. 1 or FIG. 2. Routine 300 includes a pressure control loop 302. At initiation stage 304, various inputs into a controller can be entered. The inputs can include desired operating pressures or pressure ranges for the particular system. Pressure control loop 302 is entered at stage 306, in which the pressure in the coolant system is determined. Typically, the pressure in the suction line and immediately before the compressor is determined using a pressure gauge or transducer such as that illustrated in FIG. 1. At stage 308, the comparison between the pressure, $P_n$, inside the refrigerant circuit and the targeted pressure, TP, usually equal to a desired or maximum operating pressure for the particular system, is evaluated. If the operating pressure, $P_n$, is lower (greater vacuum) or outside a pre-selected pressure range of the targeted pressure, TP, then no adjustment need be made to ensure that the system components are protected from adverse effects attributable to the operating pressure. On the other hand, if the pressure, $P_n$, is higher than the targeted maximum pressure, TP, an adjustment to one or more devices is calculated. Preferably an adjustment to the output of a metering device is calculated. Typically, limiting or modulation of the metering device begins when the operating pressure is within 3 lbs. per square inch (psig) of the targeted pressure, TP. At stage 310, for every psig within the pre-selected range limit or the 3 lb. limit mentioned above, an adjustment calculation to reduce the metering device output by one half is made. Implementation of this adjustment calculation effectively reduces the mass flow of the refrigerant through the evaporator coil. This in turn allows the pressure inside the suction line to settle to a level below the targeted pressure value, TP. In addition to modulating the metering device output, the integrated error buffer in the PID loop is also prevented from continued accumulation. This prevents "over wind" of the integral coefficient that prevents associated instability. At stage 312 the calculated adjustment is performed. Control loop 302 reenters routine 300 before stage 306 and continues then to re-determine the subsequent pressure in the suction line after modulating the metering device output. Routine 300 continues until it is desired to stop.

In alternative embodiments, it is understood that control operation 300 can be used in conjunction with one or more of control operations 200 or 100. In a preferred embodiment, control operation 300 is provided as a subroutine within control operation 200, which in turn is provided as a subroutine in control operation 100, although it would be understood that each of control operations 100, 200, and/or 300 can be operated independently if desired to control one or more functions of a refrigeration system.

The present invention contemplates modifications as would occur to those skilled in the art. It is also contemplated that processes embodied in this present invention can be altered, rearranged, substituted, deleted, duplicated, combined, and/or added to other processes as would occur to those skilled in the art without departing from the spirit of the present invention. In addition, the various stages, steps, procedures, techniques, phases, and operations within these processes may be altered, rearranged, substituted, deleted, duplicated, or combined as would occur to those skilled in the art. All publications, patents, and patent applications cited in this specification are herein incorporated by reference as if each individual publication, patent, or patent application were specifically and individually indicated to be incorporated by reference and set forth in its entirety herein. Further, any theory of operation, proof, or finding stated herein is meant to further enhance understanding of the present invention and is not intended to make the scope of the present invention dependent upon such theory, proof, or finding.

While the invention has been illustrated and described in detail in the drawings and foregoing description, the same is considered to be illustrative and not restricted in character.

Furthermore, it is understood that only the preferred embodiments have been shown and described, and that all changes and modifications that come within the spirit of the invention are desired to be protected.

What is claimed is:

1. A method of controlling a refrigeration system comprising a compressor, a coolant in a coolant circuit, a metering device, an evaporator coil, and a fan proximate to the evaporator coil, said method comprising:

defrosting the evaporator coil for a selected defrost period;

determining a load difference on the fan measured before and after said selected defrost period; and adjusting one or more of: a defrost sequence, a defrost delay period, a defrost time period, or an amount of heat transferred to said evaporator coil in response to the load difference.

2. The method of claim 1 comprising accumulating a first amount of time for a first defrost time period.

3. The method of claim 2 comprising consulting a lookup table having instructions thereon for performing a defrost sequence.

4. The method of claim 3 comprising comparing the first amount of time with a scheduled defrost time in the lookup table.

5. The method of claim 4 wherein said adjusting comprising one or more of: a defrost sequence, a defrost delay period, a defrost time period, or an amount of heat transferred to said evaporator coil in response to said comparing.

6. The method of claim 4 wherein said adjusting comprises decreasing the defrost delay period if the rotational velocity of the evaporator fan measured prior to the selected defrost period is greater than the rotational velocity of the evaporator fan measured after the selected defrost period and when a ratio of said first defrost time period to a scheduled defrost time period is less than about 0.5.

7. The method of claim 4 wherein said adjusting comprises increasing the defrost delay period if the rotational velocity of the evaporator fan measured prior to the selected defrost period is equal to the rotational velocity on the evaporator fan measured after the selected defrost period and when a ratio of said first defrost time period to a scheduled defrost time period is greater than about 0.75.

8. The method of claim 4 wherein said adjusting comprises decreasing the defrost delay period if the rotational velocity on the evaporator fan measured prior to or at the beginning of a selected defrost period is greater than the rotational velocity on the evaporator fan measured after the selected defrost period and when a ratio of said first defrost time period to a scheduled defrost time period is between about 0.5 and about 0.75.

9. The method of claim 1 wherein said determining comprises determining the rotational velocity of an evaporator fan before the selected defrost period and after the defrost period.

10. The method of claim 9 comprising:

measuring a first value indicative of the coolant pressure in the coolant circuit after the evaporator coil;

comparing the first value with a second value indicative of a desired coolant pressure; and controlling said metering device in response to said comparing.

11. The method of claim 1 wherein said adjusting comprises decreasing the defrost delay period if the load on the fan measured prior to the selected defrost period is less than the load on the fan measured after the selected defrost period.

12. The method of claim 1 wherein said adjusting comprises increasing the defrost delay period if the load on the fan measured prior to the selected defrost period is equal to the load on the fan measured after the selected defrost period.

13. The method of claim 1 comprising:

calculating a coolant superheat level of the coolant in the coolant circuit after the evaporator coil; and controlling the metering device in response to said coolant superheat level.

14. The method of claim 13 wherein said calculating comprises measuring a first value indicative of a coolant pressure in a portion of the coolant circuit downstream of the evaporator coil.

15. The method of claim 13 wherein said calculating comprises determining a temperature level of the coolant in a portion of the coolant circuit downstream of the evaporator coil.

16. The method of claim 13 wherein said calculating comprises determining a temperature difference between a temperature level of the coolant in the coolant circuit upstream of the evaporator coil and a temperature level of the coolant in the coolant circuit downstream of the evaporator coil.

17. The method of claim 13 wherein said controlling comprises reducing an output level of the metering device by an amount greater than or equal to about 62% by relative flow of the output level when said coolant superheat level of the coolant is less than or equal to about one half of a target superheat value.

18. The method of claim 13 wherein said controlling comprises reducing the output level of the metering device by to an amount equal to about $0.5^{n+1}$ times the first value wherein n is selected to equal an amount, in degrees Fahrenheit, that the coolant superheat level of the coolant is below about one half of the target superheat value.

* * * * *